US007557759B2

(12) United States Patent
Lin et al.

(10) Patent No.: US 7,557,759 B2
(45) Date of Patent: Jul. 7, 2009

(54) INTEGRATED MULTI-BAND ANTENNA

(75) Inventors: Ching-Chi Lin, Taipei Hsien (TW); Hung-Jen Chen, Taipei Hsien (TW); Kai Shih, Taipei Hsien (TW); Yu-Yuan Wu, Taipei Hsien (TW); Jia-Hung Su, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 213 days.

(21) Appl. No.: 11/772,433

(22) Filed: Jul. 2, 2007

(65) Prior Publication Data

US 2009/0009413 A1 Jan. 8, 2009

(51) Int. Cl.
*H01Q 1/24* (2006.01)

(52) U.S. Cl. ..... 343/702; 343/731; 343/806; 343/828

(58) Field of Classification Search ..... 343/702, 343/731, 741, 744, 806, 828, 895
See application file for complete search history.

(56) References Cited

U.S. PATENT DOCUMENTS 6,198,442 B1 * 3/2001 Rutkowski et al. ..... 343/702
7,109,923 B2 * 9/2006 Ollikainen et al. .... 343/700 MS
7,486,241 B2 * 2/2009 Qi et al. ..... 343/702
2004/0090372 A1 * 5/2004 Nallo et al. ..... 343/700 MS

* cited by examiner

*Primary Examiner*—Douglas W. Owens
*Assistant Examiner*—Chuc Tran
(74) *Attorney, Agent, or Firm*—WPAT, P.C.; Anthony King

(57) ABSTRACT

An integrated multi-band antenna has a first radiating conductor, a second radiating conductor spaced from the first radiating conductor, a trap element connected to the first and second radiating conductors, a third radiating conductor with a first feeding point connected to the first radiating conductor, a fourth radiating conductor connected to the second and third radiating conductors, a meandering radiating conductor having two ends which respectively connect a fifth radiating conductor with a second radiating conductor and a sixth radiating conductor parallel to the meandering radiating conductor and a ground portion arranged close to the first radiating conductor and spaced from the fifth radiating conductor. The second, third and fourth radiating conductors resonate at a first frequency bandwidth. The first, second and third radiating conductor and the trap element resonate a second frequency bandwidth. The fifth, sixth and meandering radiating conductors resonate a third and a fourth frequency bandwidths.

18 Claims, 5 Drawing Sheets

INTEGRATED MULTI-BAND ANTENNA

BACKGROUND OF THE INVENTION

1. Field of the Invention

The invention relates to an integrated multi-band antenna, and particularly to an integrated multi-band antenna capable of operating at telecommunication frequency and wireless local area network frequency.

2. The Related Art

Recently, a portable electrical device is required to be compact, light, and multi-functional according to a recent demand. Electrical circuits and components built in the mobile communication terminal become smaller and more multi-functional in order to satisfy the above requirement. Also, the requirement is applied to an antenna, which is one of major components of the portable electrical device for wireless communication purpose.

Wireless communication bands contain telecommunication frequency bands and wireless local area network frequency bands. Telecommunication frequency bands include global system for mobile communications (GSM) frequency band about 850 mega-hertz (MHz), extended global system for mobile communications (EGSM) frequency band about 900 MHz, digital cellular system (DCS) frequency band about 1800 MHz, personal conferencing specification (PCS) frequency band about 1900 MHz, wideband code division multiple access (W-CDMA) frequency band about 2100 MHz.

Wireless local area network frequency bands include 2.4 giga-hertz (GHz) and 5.2 GHz nowadays. Therefore, an antenna capable of operating at telecommunication frequency bands and wireless local area network frequency bands being mentioned above is a necessary component for the portable electrical device.

SUMMARY OF THE INVENTION

An object of the present invention is to provide an integrated multi-band antenna having a first radiating element and a second radiating element arranged on a dielectric element. The dielectric element has a top surface, a first surface connected to the top surface, a second surface connected to the top surface and a third surface connected to the top surface, the first surface and the second surface. The first radiating element has a first radiating conductor and a second radiating conductor separated to each other and arranged on the top surface of the dielectric element.

A trap element connects the first radiating conductor and the second radiating conductor. A third radiating conductor and a fourth radiating conductor are arranged on the first surface of the dielectric element. The third radiating conductor connects the first radiating conductor. The fourth radiating conductor connects the second radiating conductor and the third radiating conductor.

The second radiating element has a fifth radiating conductor arranged on the third surface of the dielectric element. A sixth radiating conductor is arranged on the second surface of the dielectric element. A meandering radiating conductor is arranged on the top surface of the dielectric element and connected to the fifth radiating conductor and the sixth radiating conductor.

When the integrated multi-band antenna operates at wireless communications, the first radiating element obtains a frequency bandwidth covering 850 MHz, 900 MHz, 1800 MHz, 1900 MHz and 2100 MHz, and the second radiating element obtains another frequency bandwidth covering 2.4 GHz and 5.2 GHz.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
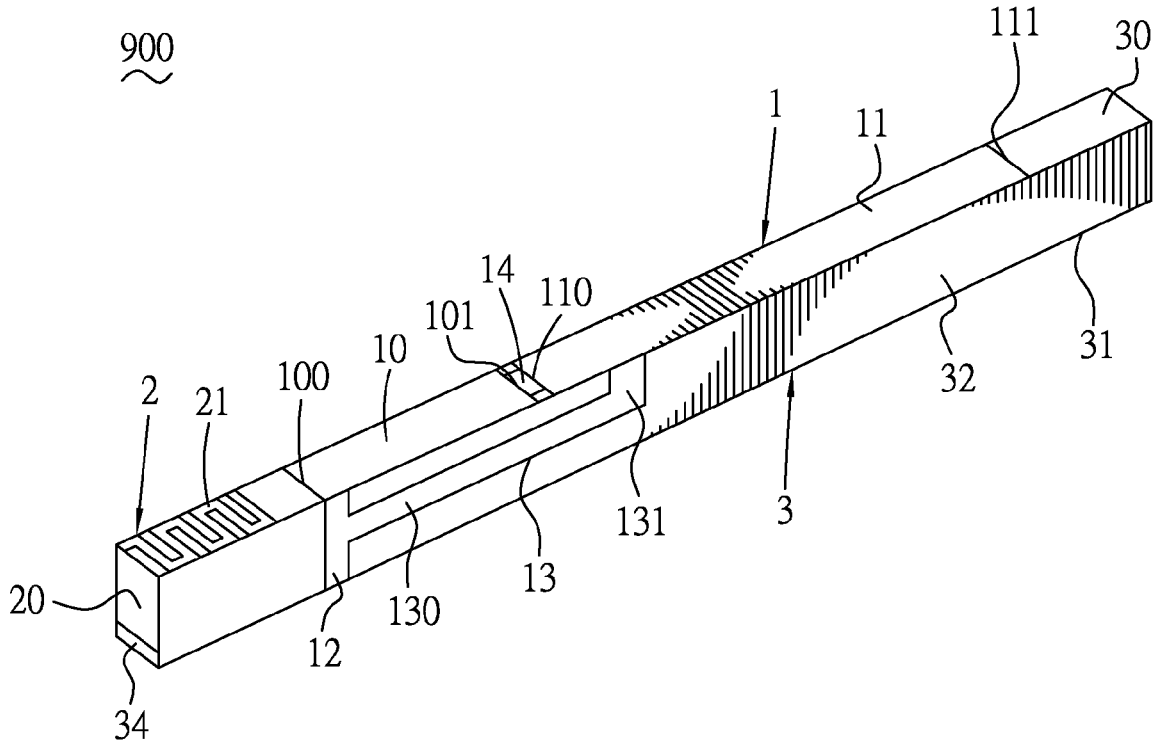
FIG. 1 is a perspective view showing rear side of an integrated multi-band antenna according to the present invention.

Please refer to FIG. 1. A preferred embodiment of an integrated multi-band antenna 900 according to the present invention is shown. The integrated multi-band antenna 900 has a first radiating element 1 and a second radiating element 2 spaced from the first radiating element 1. The first radiating element 1 and the second radiating element 2 are arranged on a dielectric element 3. The first radiating element 1 and the second radiating element 2 are made of metal material. In this case, the dielectric element 3 is an insulation housing.

The dielectric element 3 has a top surface 30, a bottom surface 31 opposite to the top surface 30, a first surface 32 connected to the top surface 30 and the bottom surface 31, a second surface 33 connected to the top surface 30 and the bottom surface 31, and a third surface 34 connected to the top surface 30, the bottom surface 31, the first surface 32 and the second surface 33. In this case, the dielectric element 3 is a rectangle.

The first radiating element 1 has a first radiating conductor 10, a second radiating conductor 11, a third radiating conductor 12, a fourth radiating conductor 13 and a trap element 14. The first radiating conductor 10 is defined a first end 100 and a second end 101 opposite to the first end 100, and arranged on the top surface 30 of the dielectric element 3. The second radiating conductor 11 is defined a third end 110 and a fourth end 111 opposite to the third end 110, and arranged on the top surface 30 of the dielectric element 3.

The first radiating conductor 10 is spaced from the second radiating conductor 11. In this case, the second end 101 of the first radiating conductor 10 is spaced from and faced to the third end 110 of the second radiating conductor 11. The third radiating conductor 12 is arranged on the first surface 32 of the dielectric element 3 and defined opposite ends. One end of the third radiating conductor 12 connects the first end 100 of the first radiating conductor 10. The other end of the third radiating conductor 12 with a first feeding point is arranged close to a ground portion.

The fourth radiating conductor 13 is arranged on the first surface 32 of the dielectric element 3. The fourth radiating conductor 13 has a first section 130 and a second section 131 connected to the first section 130. The first section 130 of the fourth radiating conductor 13 is spaced from and parallels the first radiating conductor 10 and the second radiating conductor 11, which connects the third radiating conductor 12. The second section 131 of the fourth radiating conductor 13 connects the vicinity of the third end 110 of the second radiating conductor 11.

The trap element 14 is arranged on the top surface 30 of the dielectric element 3 and connected to first radiating conductor 10 and the second radiating conductor 11. In this case, the trap element 14 is connected and arranged between the second end 101 of the first radiating conductor 10 and the third end 110 of the second radiating conductor 11. The trap element 14 may be capacitance, inductance or combination of capacitance and inductance.

Figure 2:
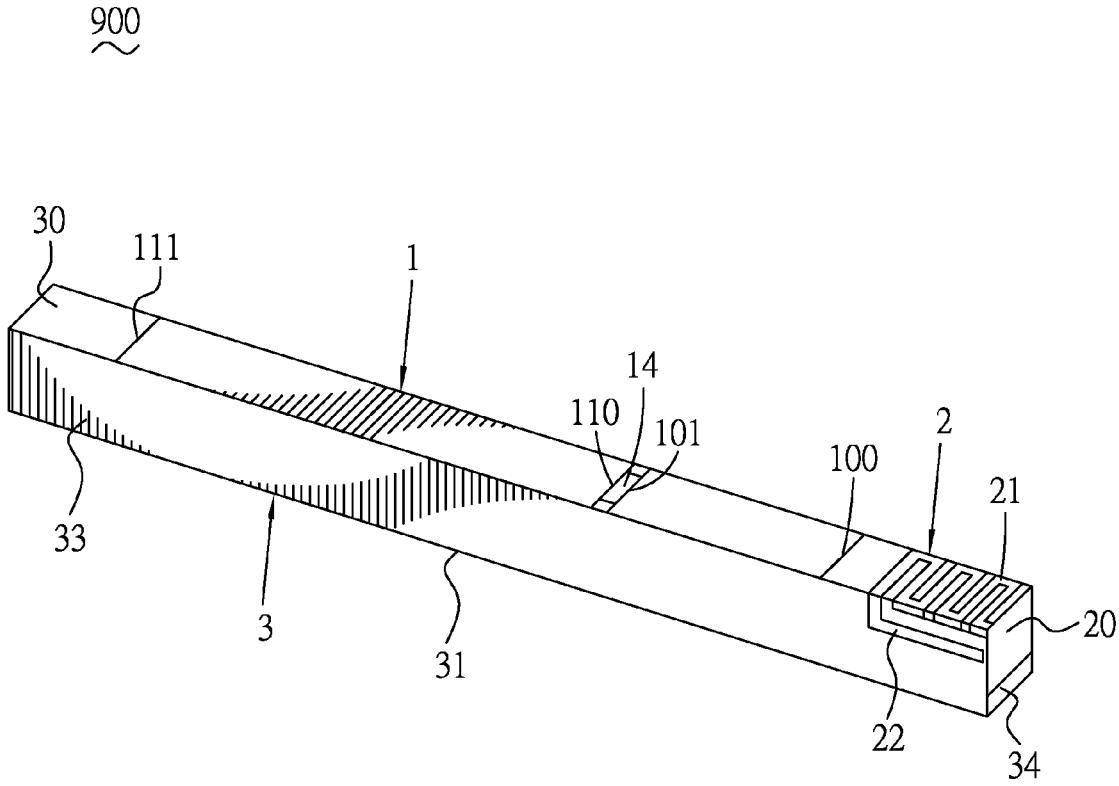
FIG. 2 is a perspective view showing front side of the integrated multi-band antenna according to the present invention.

Please refer to FIG. 1 and FIG. 2. The second radiating element 2 is spaced from the first end 100 of the first radiating conductor 10. The second radiating element 2 has a fifth radiating conductor 20, a meandering radiating conductor 21 and a sixth radiating conductor 22. The fifth radiating conductor 20 with a second feeding point is arranged on the third surface 34 of the dielectric element 3 and spaced from the ground portion.

The meandering radiating conductor 21 is arranged on the top surface 30 of the dielectric element 3. The meandering radiating conductor 21 is defined two ends which are connected to the fifth radiating conductor 20 and the sixth radiating conductor 22 respectively. The sixth radiating conductor 22 is arranged on the second surface 33 of the dielectric element 3. The sixth radiating conductor 22 is spaced from and parallels the meandering radiating conductor 21.

Figure 3:
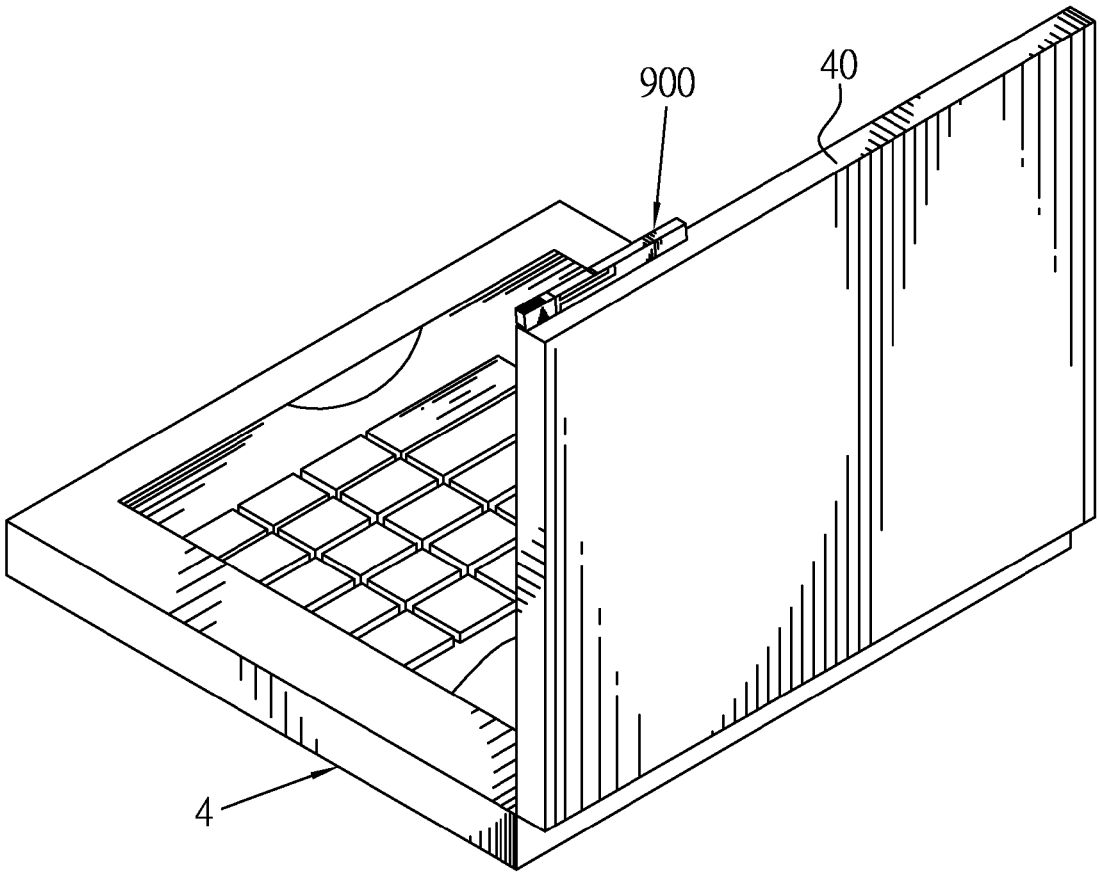
FIG. 3 is a perspective view illustrating the integrated multi-band antenna configured in a notebook according to the present invention.
Figure 4:
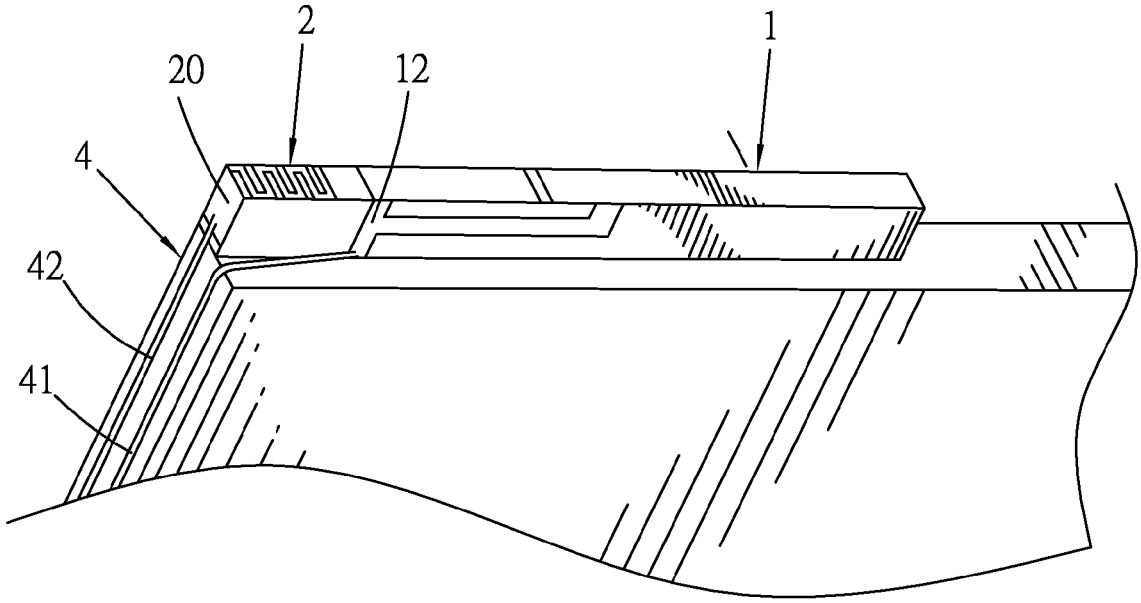
FIG. 4 is a perspective view illustrating rear side of the integrated multi-band antenna configured in the notebook according to the present invention.
Figure 5:
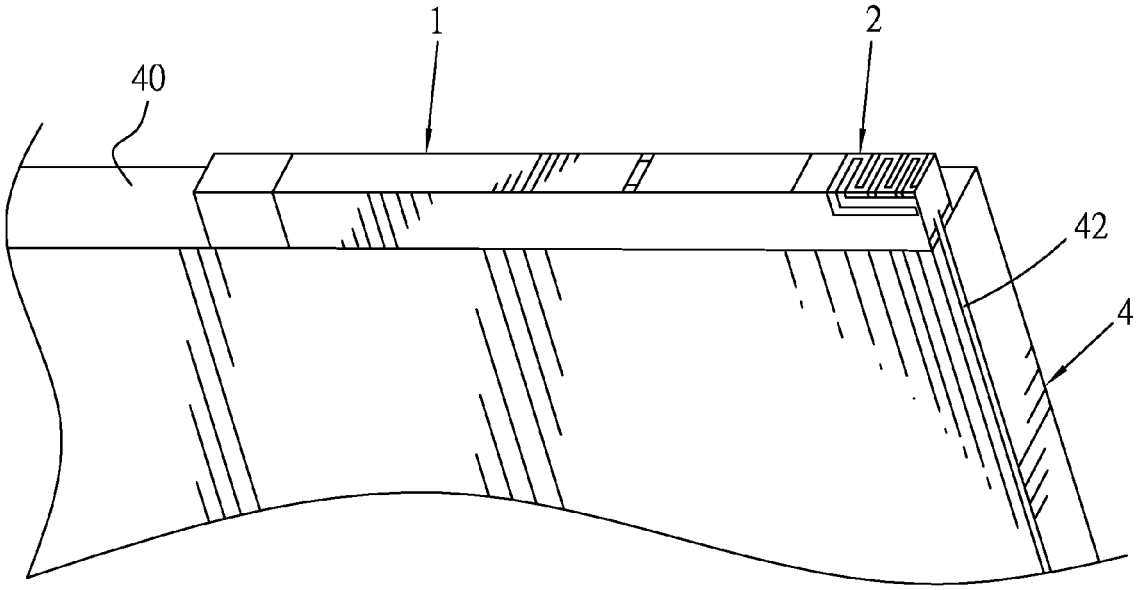
FIG. 5 is a perspective view illustrating front side of the integrated multi-band antenna configured in the notebook according to the present invention.

Please refer to FIG. 3, FIG. 4 and FIG. 5. The integrated multi-band antenna 900 is configured in an electric device such as a laptop 4. The integrated multi-band antenna 900 is configured in the laptop 4 and the bottom surface 31 of the dielectric element 3 is attached on the top of the metal shield of the display 40 of the laptop 4. The first radiating element 1 and the second radiating element 2 of the integrated multi-band antenna 900 electronically connect a first communication module and a second communication module (not shown in figures) of the laptop 4 through a first cable 41 and a second cable 42 respectively.

In this case, one end of the first cable 41 connects the first feeding point of the first radiating element 1 of the integrated multi-band antenna 900. The other end of the first cable 41 connects the first communication module of the laptop 4. One end of the second cable 42 connects the second feeding point of the second radiating element 2 of the integrated multi-band antenna 900. The other end of the second cable 42 connects the second communication module of the laptop 4. In this case, the metal shield of the display of the laptop 4 electronically connects the ground portion of the integrated multi-band antenna 900.

When the integrated multi-band antenna 900 operates at wireless communication, the second radiating conductor 11, the third radiating conductor 12 and the fourth radiating conductor 13 of the first radiating element 1 obtain an electrical resonance corresponding to a quarter wavelength corresponding to a first frequency bandwidth covering 850 MHz and 900 MHz. The first radiating conductor 10, the second radiating conductor 11, the third radiating conductor 12 and the trap element 14 of the first radiating element 1 obtain an electrical resonance corresponding to a quarter wavelength corresponding to a second frequency bandwidth covering 1800 MHz, 1900 MHz and 2100 MHz.

The second radiating element 2 obtains an electrical resonance corresponding to a quarter wavelength corresponding to a third frequency bandwidth covering 2.4 GHz. The second radiating element 2 further obtains an electrical resonance corresponding to a quarter wavelength corresponding to a fourth frequency bandwidth covering 5.2 GHz.

In this case, changing the gap between the first section 130 of the fourth radiating conductor 13 and the first and second radiating conductor 10, 11 influences gain of the first and second frequency bandwidth of the first radiating element 1. When the first section 130 of the fourth radiating conductor 13 is arranged close to the first and second radiating conductor 10, 11, gain of the second frequency is decreased. When the first section 130 of the fourth radiating conductor 13 is arranged far from the first and second radiating conductor 10, 11, gain of the first frequency is decreased.

In this case, adjusting turns of the meandering radiating conductor 21 influences gain of the third frequency bandwidth of the second radiating element 2. Changing the gap between the meandering radiating conductor 21 and the sixth radiating conductor 22 influences gain of the fourth frequency bandwidth of the second radiating element 2.

The integrated multi-band antenna 900 has the first radiating element 1 obtaining the first frequency and the second frequency bandwidth covering 850 MHz, 900 MHz, 1800 MHz, 1900 MHz and 2100 MHz. The integrated multi-band antenna 900 further has the second radiating element 2 obtaining the third frequency bandwidth and the fourth frequency bandwidth covering 2.4 GHz and 5.2 GHz. Therefore, the integrated multi-band antenna 900 operates at telecommunication frequency and wireless local area network frequency.

Furthermore, the present invention is not limited to the embodiments described above; various additions, alterations and the like may be made within the scope of the present invention by a person skilled in the art. For example, respective embodiments may be appropriately combined.

What is claimed is:

1. An integrated multi-band antenna arranged on a dielectric element defined a top surface, a first surface connected to said top surface, a second surface connected to said first surface and a third surface connected to said top surface, said first surface and said second surface, comprising:

a first radiating conductor arranged on said top surface of said dielectric element;

a second radiating conductor spaced from said first radiating conductor and arranged on said top surface of said dielectric element;

a trap element connected to said first radiating conductor and said second radiating conductor;

a third radiating conductor with a first feeding point connected to said first radiating conductor and arranged on said first surface of said dielectric element;

a fourth radiating conductor connected to said second radiating conductor and said third radiating conductor, and arranged on said first surface of said dielectric element;

a fifth radiating conductor with a second feeding point arranged on said third surface of said dielectric element;

a sixth radiating conductor arranged on said second surface of said dielectric element;

a meandering radiating conductor connected to said fifth radiating conductor and said sixth radiating conductor and spaced from said first radiating conductor and said sixth radiating conductor; and a ground portion close to the first radiating conductor and spaced from said fifth radiating conductor.

2. The integrated multi-band antenna as claimed in claim 1, wherein said first radiating conductor is defined a first end and a second end opposite to said first end, said second radiating conductor is defined a third end and a fourth end opposite to said third end, said second end of said first radiating conductor faces said third end of said second radiating conductor, said third radiating conductor connects said first end of said first radiating conductor, said fourth radiating conductor connects the vicinity of said third end of said second radiating conductor.

3. The integrated multi-band antenna as claimed in claim 2, wherein said fourth radiating conductor has a first section and a second section connected to said first section, said first section of said fourth radiating conductor connects said third radiating conductor, said first section of said fourth radiating conductor is spaced from and parallels said first and second radiating conductors, said second section of said fourth radiating conductor connects the vicinity of said third end of said second radiating conductor.

4. The integrated multi-band antenna as claimed in claim 2, wherein said trap element connects said second end of said first radiating conductor and said third end of said second radiating conductor.

5. The integrated multi-band antenna as claimed in claim 2, wherein said meandering radiating conductor is spaced from said first end of said first radiating conductor.

6. The integrated multi-band antenna as claimed in claim 1, wherein said meandering radiating conductor is parallel to said sixth radiating conductor.

7. The integrated multi-band antenna as claimed in claim 1, wherein said dielectric element comprises a bottom surface opposite to said top surface, said bottom surface is attached on a metal shield of an electric device, said metal shield of said electric device electronically connects said ground portion.

8. An integrated multi-band antenna comprising:

a first radiating conductor defined a first end and a second end;

a second radiating conductor defined a third end and a fourth end, said third end faced to said second end of said first radiating conductor;

a trap element connected to said first radiating conductor and said second radiating conductor;

a third radiating conductor defined opposite ends, one end of said third radiating conductor connected to said first end of first radiating conductor, the other end of said third radiating conductor having a first feeding point and close to a ground portion;

a fourth radiating conductor connected to said third radiating conductor and the vicinity of said third end of said second radiating conductor;

a fifth radiating conductor with a second feeding conductor spaced from said ground portion;

a meandering radiating conductor defined two ends, one end of said meandering radiating conductor connected to said fifth radiating conductor; and a sixth radiating conductor connected to and paralleling the other end of said meandering radiating conductor.

9. The integrated multi-band antenna as claimed in claim 8, wherein said trap element connects said second end of said first radiating conductor and said third end of said second radiating conductor.

10. The integrated multi-band antenna as claimed in claim 8, wherein said fourth radiating conductor has a first section and a second section connected to said first section, said first section connects said third radiating conductor, said first section is parallel to said first radiating conductor and said second radiating conductor, said second section connects the vicinity of said third end of said second radiating conductor.

11. The integrated multi-band antenna as claimed in claim 8, wherein said meandering radiating conductor is spaced from said first end of said first radiating conductor.

12. The integrated multi-band antenna as claimed in claim 8, further comprising a dielectric element having a top surface, a first surface connected to said top surface, a second surface connected to said top surface and a third surface connected to said top surface, said first surface and said second surface, said first radiating conductor, said second radiating conductor, said trap element and said meandering radiating conductor arranged on said top surface, said third radiating conductor and said fourth radiating conductor arranged on said first surface, said sixth radiating conductor arranged on said second surface, said fifth radiating conductor arranged on said third surface.

13. The integrated multi-band antenna as claimed in claim 12, wherein said dielectric has a bottom surface opposite to said top surface, said bottom surface of said dielectric element is attached on a metal shield of an electric device, said ground portion electronically connects said metal shield of said electric device.

14. The integrated multi-band antenna as claimed in claim 8, wherein said second radiating conductor, said third radiating conductor and said fourth radiating conductor resonate at a first frequency bandwidth, said first radiating, said second radiating conductor, said third radiating conductor and said trap element resonate at a second frequency bandwidth, said second frequency bandwidth is double to triple frequency higher than said first frequency bandwidth.

15. The integrated multi-band antenna as claimed in claim 8, wherein said fifth radiating conductor, said sixth radiating conductor and said meandering radiating conductor resonate at a third frequency bandwidth and a fourth frequency bandwidth, said fourth frequency bandwidth is double to triple frequency higher than said third frequency bandwidth.

16. The integrated multi-band antenna as claimed in claim 14, wherein change of the gap between said first section of said fourth radiating conductor and said first radiating conductor associates gain of said second frequency bandwidth.

17. The integrated multi-band antenna as claimed in claim 14, wherein change of the gap between said first section of said fourth radiating conductor and said second radiating conductor associates gain of said first frequency bandwidth.

18. The integrated multi-band antenna as claimed in claim 15, wherein change of the gap between said meandering radiating conductor and said sixth radiating conductors associates gain of said fourth frequency bandwidth.

* * * * *